United States Patent [19]

Hansen et al.

[11] Patent Number: 4,750,911

[45] Date of Patent: Jun. 14, 1988

[54] FLAME-RESISTANT NYLON/COTTON FABRICS

[75] Inventors: John H. Hansen, Greensboro; James R. Johnson, McLeansville, both of N.C.

[73] Assignee: Burlington Industries, Inc., Greensboro, N.C.

[21] Appl. No.: 911,720

[22] Filed: Sep. 26, 1986

[51] Int. Cl.[4] ..... C09B 67/00

[52] U.S. Cl. ..... 8/584; 106/18.19; 427/393.3; 8/127.1

[58] Field of Search ..... 8/181, 127.1, 584; 106/18.19; 427/393.3

[56] References Cited

U.S. PATENT DOCUMENTS

| | | | |
|---|---|---|---|
| 3,789,091 | 1/1974 | Anderson | 260/927 R |
| 3,849,368 | 11/1974 | Anderson | 260/45.8 R |
| 3,877,974 | 11/1976 | Mischutin | 428/290 |
| 3,974,310 | 5/1970 | Mischutin | 427/390 |
| 4,078,101 | 3/1978 | Cole | 427/341 |
| 4,116,702 | 9/1978 | Rohringer et al. | 106/15 FP |
| 4,120,798 | 10/1978 | Mischutin | 252/8.1 |
| 4,139,476 | 2/1979 | Hancock | 252/8.1 |
| 4,145,463 | 3/1979 | Cole | 427/337 |
| 4,158,077 | 6/1979 | Mischutin | 427/381 |
| 4,237,157 | 12/1980 | Hancock | 427/352 |
| 4,246,031 | 1/1981 | Elgal et al. | 106/18.14 |
| 4,348,306 | 9/1982 | Mischutin | 252/608 |
| 4,397,759 | 8/1983 | Hancock | 252/609 |
| 4,494,451 | 1/1985 | Cole et al. | 8/116 P |

OTHER PUBLICATIONS

"Antiblaze 19", Data Sheet, (no date).
Albright & Wilson Product Data Sheet.
Albright & Wilson Material Safety Data Bulletin.
W. A. Sanderson et al., Textile Research Journal, 40, 458, 217, (1970).

*Primary Examiner*—A. Lionel Clingman
*Assistant Examiner*—John F. McNally
*Attorney, Agent, or Firm*—Nixon & Vanderhye

[57] ABSTRACT

Nylon/cotton fabrics are fire retarded with a flame-retardant cyclic phosphonate ester and tetrakis-(hydroxymethyl)phosphonium sulfate (THPS), usually applied simultaneously, then cured. The resulting fabrics retain their flame-resistant properties after numerous machine washings and have an acceptable hand.

14 Claims, No Drawings

FLAME-RESISTANT NYLON/COTTON FABRICS

This invention relates to a process for imparting flame-resistant properties to nylon/cotton blended fabrics. In its preferred form, it uses two flame-retardant chemicals or flame-retardant systems, one specific to the nylon component and the other specific to the cotton component.

BACKGROUND OF THE INVENTION

Prior attempts to achieve acceptable flame-resistant nylon/cotton blends have not met with commercial success. None of the treatments are practical from the consumer point of view, producing fabrics that have a very stiff hand. This is because in order to achieve the requisite flame-resistant properties, a high chemical add-on is required. This add-on makes the fabric stiff, masks the color of the underlying fabric, and often imparts an acrid or unacceptable odor to the fabric. In addition, the performance of the flame resistant fabrics is often unreliable.

Acceptable flame resistance has been obtained on nylon/cotton blends by use of White Chemical Company's finish "Caliban P-44", which employs a high add-on of decabromobiphenyl oxide and antimony oxide. However, this flame retardant is held on the fabric by a substantial quantity of latex binder, and the finished fabric has an unacceptably stiff, rubbery hand and seriously altered appearance.

Most of the previous work conducted on flame-resistant nylon/cotton blends used a single chemical system that was targeted for the cotton component of the blend. The approach was to "load" the fabrics with a flame retardant specific for cotton, for instance THPS [tetrakis-(hydroxymethyl)phosphonium sulfate]. It was not unusual with these earlier products to use from 30 to 35% of fixed chemical add-on in order for the nylon/-cotton blend fabric to pass a bottom vertical flame test. Regrettably, however, the aesthetics of the finished fabrics were poor, as they had a very stiff hand and the appearance of a coated fabric. The add-ons used for these products were far in excess of the theoretically required amounts.

When THPS is applied to a nylon/cotton blend, about 1.7% of fixed phosphorus is required to achieve flame resistance. The use of this quantity of reagent typically results in a stiff fabric with unacceptable hand. An object of the present invention is to produce acceptable flame-resistant nylon/cotton blends using multiple flame-retardant chemicals or chemical systems, and to employ processing conditions or adjuvants that produce a commercially acceptable, attractive product having good color and acceptable hand.

Disclosed is a process for imparting flame-resistant properties to a nylon/cotton blend fabric, usually containing from at least 15 weight percent up to 55 or 60 weight percent nylon, by applying either separately or simultaneously, a flame retarding amount of (a) a cyclic phosphonate ester flame retardant that fixes onto the nylon fibers and (b) a flame retarding amount of a tetrakis-(hydroxymethyl)phosphonium salt/urea polymer that fixes onto and into the fibers of the cotton fibers. The flame retardants are applied to the fabric, either separately or together, conveniently by padding, then the coated fabric is heated to cure the polymer and fix both flame retardants on to the nylon and cotton fibers, respectively.

BRIEF DESCRIPTION OF THE INVENTION

The process of the present invention employs two flame-retardant systems, one specific to the nylon component and the other specific to the cotton component of the nylon/cotton blends being flame-retarded. With this approach, the amount of flame retardant, such as THPS, required to satisfy flame resistance standards can be reduced significantly, and the resulting fabrics have not only better flame-resistant characteristics, but also better aesthetics. In the process disclosed in more detail below, different flame retardants are applied simultaneously in a single bath. In addition, application in multiple steps can be used to achieve more efficient and more economical use of the rather costly flame-retardant chemicals. Processing conditions, especially temperatures and humidities, are carefully controlled in order to optimize the use of the flame-retardant chemicals and to ensure good fixation to the nylon/cotton blends, even after several launderings.

The nylon/cotton blends treated in accordance with the present invention contain between 3% and 55% of nylon, the balance being cotton.

The nylon/cotton fibrous materials which can be provided with a flame-retardant finish according to the invention can be in any desired stage of processing, i.e., they can be treated as woven or knitted fabrics, dyed or undyed, or as textiles which have already been further processed.

DETAILED DESCRIPTION OF THE INVENTION

The invention disclosed herein has several aspects which, for convenience, may be summarized according to the following scheme:

A mixture of flame retardants is applied, one member of the mixture specific for cotton and the other for nylon, after the fabric is dyed. According to the preferred method of the inventive process, the same bath is used to apply a mixture of two (or more) flame-retardant chemicals, one specific for the nylon component of the blend, and the other specific for the cotton component of the blend. As used herein, the preferred nylon flame retardant (FR) is Antiblaze 19 or 19T, a cyclic phosphonate available from Albright & Wilson Chemical Co. The preferred flame retardant specific to the cotton component of the blend is THPS, which is compatible with AB-19, and thus may be applied together in a single FR treatment bath, such as by padding onto the fabric with a fixed add-on typically in the range of 20–25% by weight. This combination pad bath is not recommended for fabrics dyed with direct, vat or reactive dyes as they tend to change color. However, naphthols, acid dyes and cationic dyes are fully acceptable. The hand of fabrics so treated is substantially superior to the hand of any flame-resistant nylon/cotton fabrics heretofore known to the art. The hand can be further improved by the use of a softener such as Aerotex H Softener, a cationic product with nonionic and anionic moieties, manufactured by American Cyanamid Co.

The hand of the treated fabrics can be still further improved by conducting the curing operation in a moist, high-humidity environment.

The invention will now be illustrated with reference to the following examples in which all parts and percentages are by weight and temperatures reported in degrees Fahrenheit, unless otherwise indicated. The materials used are more fully described as follows:

Among the flame-retardant materials used in accordance with the present invention are thermally stable cyclic phosphonate esters prepared by reacting alkyl-halogen-free esters with a bicyclic phosphite. As a class, these cyclic phosphonate esters are represented by one of the formulas:

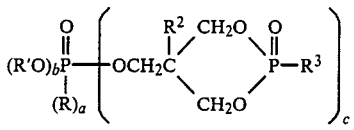

(A)

where a is 0 or 1; b is 0, 1 or 2, c is 1, 2 or 3 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or

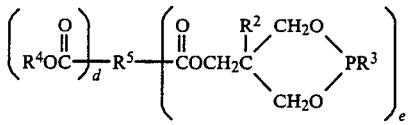

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$) phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or trivalent phenenyl.

The preferred compounds (see below) are represented by the formula:

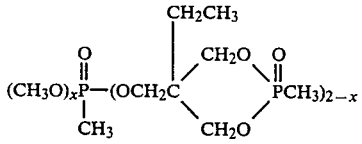

in which X is 0 or 1, and usually a 50:50 mixture of the mono- and di-esters. The preparation of these cyclic phosphonate esters and their use as flame retardants are described in U.S. Pat. Nos. 3,789,091 and 3,849,368, the disclosures of which are hereby incorporated by reference.

Antiblaze 19T, as described by the supplier Albright & Wilson Inc., of Richmond, Va., is a cyclic phosphonate ester, available as an odorless viscous liquid (viscosity 6000 SMS at 100° F.) with a flashpoint of 340° F. (ASTM D-93).

Tetrakis-(hydroxymethyl)phosphonium sulfate (THPS), also available from Albright & Wilson, Inc., under the name Retardol S, is a pale, straw-colored liquid that is miscible with water and has a pungent odor. Several related compounds can be used in place of THPS, including tetrakis-(hydroxymethyl)phosphonium chloride (THPC), available under the name Retardol C from Albright and Wilson, and tetrakis-(hydroxymethyl)phosphonium oxalate, available as Pyroset TKS from American Cyanamid Company.

THPS when mixed with urea and heated strongly forms a relatively insoluble polymer, containing both phosphorus and nitrogen, inside the cotton fibers, and around both the cotton and the nylon fibers. Insolubility of this polymer is increased further by oxidizing the phosphorus with hydrogen peroxide.

Aerotex H is described by its supplier, American Cyanamid Co., as a cationic product with nonionic and anionic moieties, and is included in the pad path formulation as a softener.

TMN-10 is ethoxylated 2,6,8-trimethylnonanol, commercially available from Union Carbide Corporation.

Flame Resistance Testing Method—the following testing procedures was used:

FR Federal Test Method 5903 is intended for use in determining the resistance of cloth to flame and glow propagation and tendency to char. A rectangular cloth test specimen (70 mm×120 mm) with the long dimension parallel to the warp or fill direction is placed in a holder and suspended verticaly in a cabinet with the lower end ¾ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen may continue to flame after the burner is extinguished. The time in seconds the specimen continues to glow after the specimen has ceased to flame is reported as afterglow time; if the specimen glows for more than 30 seconds, it is removed from the test cabinet, taking care not to fan the glow, and suspended in a draft-free area in the same vertical position as in the test cabinet. Char length, the distance from the end of the specimen, which was exposed to the flame, to the end of a lengthwise tear through the center of the charred area to the highest peak in the charred area, is also measured. Five specimens from each sample are usually measured and the results averaged.

EXAMPLE I

A bath containing 50% of a tetrakis-(hydroxymethyl)phosphonium sulfate preparation (Retardol S from Albright & Wilson), 15.7% urea, 9.3% cyclic phosphate ester (Antiblaze 19 from Albright & Wilson), 2% disodium phosphate, 2% fabric softener (Aerotex H from American Cyanamid) and 0.1% nonionic surfactant was prepared. This bath was padded onto a dyed and printed nylon/cotton twill (ca. 55% nylon, 7.8 oz/sq yd). Wet pickup was 61.5%. The fabric was dried and cured for 90 seconds in an oven at 360° F. The treated fabric was oxidized in a solution containing hydrogen peroxide and sodium hydroxide, rinsed well and dried.

Four samples of the fabric were tested in the manner described in Federal Test Method 5903. Average char length was 2.25 inches; none of the samples exhibited either afterflame or afterglow. Similar testing after the fabric had been subjected to 10 home launderings gave an average char length of 2.5 inches with no afterflame or afterglow. These results indicate that the treatment was highly effective in imparting flame resistance to the nylon/cotton fabric.

EXAMPLE II

In similar trials, two baths described as A and B below were padded onto dyed and printed nylon/cotton twill (55.8% nylon). The fabric samples were dried and cured for 75 seconds in an oven at 370° F. Oxidation and testing were done as described in the previous example.

| | A | B |
|---|---|---|
| THPS (Retardol S) | 55.0% | 55.0% |
| Urea | 14.85 | 12.1 |
| Antiblaze 19T | 9.3 | 9.3 |
| Aerotex H | 2.0 | 2.0 |
| Surfactant | 0.1 | 0.1 |
| Wet Pick-up | 63.4% | 62.4% |
| Average Char Length | | |
| As-finished | 2.0 inches | 1.9 inches |
| Laundered 25 times | 2.0 | 2.1 |

The results show that the flame-retardant treatments were very effective, and the hand of the fabric was quite acceptable.

EXAMPLE III

In similar trials, the baths described below were padded onto two nylon/cotton fabrics. Fabric A was a ripstop weave, 6.2 oz/sq yd, 2.8% nylon. Fabric B was a twill, 5.3 oz/sq yd, 53.1% nylon. The fabric samples were dried and cured for 60 seconds in an oven at 360° F. Oxidation and testing were done as described in the previous example. Char is reported in inches, fails as the fraction of the number that failed over the number of samples tested.

| | Bath 1 | Bath 2 | Bath 3 | Bath 4 |
|---|---|---|---|---|
| Retardol S | 30.0% | 40.0 | 50.0 | 60.0 |
| Urea | 7.5 | 10.0 | 12.5 | 15.0 |
| Antiblaze 19 | 9.3 | 9.3 | 9.3 | 9.3 |
| Disodium phosphate | 2.0 | 2.0 | 2.0 | 2.0 |
| Aerotex H | 2.0 | 2.0 | 2.0 | 2.0 |
| Surfactant (TMN-10) | 0.2 | 0.2 | 0.2 | 0.2 |

| | | As-Finished | | | Laundered 25 Times | | |
|---|---|---|---|---|---|---|---|
| | | TM 5903 | | % Phos- | TM 5903 | | % Phos- |
| Fabric | Bath | Char | Fails | phorus | Char | Fails | phorus |
| A | 1 | — | ¼ | 1.7 | — | ¾ | 1.3 |
| A | 2 | 1.9 | 0 | 2.1 | 2.6 | 0 | 1.7 |
| A | 3 | 1.7 | 0 | 2.7 | 1.6 | 0 | 2.2 |
| A | 4 | 1.4 | 0 | 3.3 | 1.6 | 0 | 2.5 |
| B | 1 | 2.0 | 0 | 1.8 | — | ¼ | 1.3 |
| B | 2 | 2.1 | 0 | 2.3 | 2.4 | 0 | 1.6 |
| B | 3 | 1.9 | 0 | 2.8 | 2.1 | 0 | 2.1 |
| B | 4 | 1.5 | 0 | 3.6 | 2.3 | 0 | 2.5 |

The treated fabric containing at least 1.6% of phosphorus had excellent flame resistance and good esthetic properties.

What is claimed is:

1. A process of imparting durable flame-resistance after multiple launderings to a nylon/cotton blend fabric comprising the steps of:

(1) applying to a nylon/cotton blend fabric, at least about 3% by weight of which is nylon, balance cotton, a flame retarding amount of a cyclic phosphonate ester flame retardant that fixes onto nylon fibers, and a flame retarding amount of tetrakis-(hydroxymethyl)phosphonium salt/urea that fixes onto cotton fibers, the flame retardant chemicals applied to the fabric simultaneously as a mixture; and (2) curing the fabric at elevated temperatures to fix the flame retardants to the nylon and to the cotton, the treated fabric containing at least 1.6% phosphorus after 25 launderings.

2. The process of claim 1 in which the amount of nylon in the nylon/cotton blend is in the range of from 35 up to about 55 percent by weight.

3. The process of claim 1 in which a greige fabric is flame retardant treated prior to dyeing.

4. The process of claim 1 in which the curing is conducted in the presence of up to about 22% absolute humidity.

5. The process of claim 4 in which the curing is conducted in the presence of about 10% absolute humidity.

6. The process of claim 5 in which the curing is conducted at a temperature in the range of about 300° F. to about 420° F.

7. The process of claim 1 in which the phosphorus-containing flame retardant specific for the cotton component is tetrakis-(hydroxymethyl)phosphonium sulfate.

8. The process of claim 1 in which the phosphorus-containing flame retardant specific for the cotton component is tetrakis-(hydroxymethyl)phosphonium chloride.

9. The process of claim 1 in which the phosphorus-containing flame retardant specific for the cotton is tetrakis-(hydroxymethyl)phosphonium oxalate.

10. A flame resistant nylon/cotton blend fabric produced by the process of claim 1.

11. A flame resistant nylon/cotton blend fabric produced by the process of claim 7.

12. A flame resistant nylon/cotton blend fabric produced by the process of claim 8.

13. A flame resistant nylon/cotton blend fabric produced by the process of claim 9.

14. A process of imparting durable flame-resistance after multiple launderings to a nylon/cotton blend fabric comprising the steps of:

(1) applying simultaneously in a single bath to a nylon/cotton blend fabric, containing from about 35 to about 55% by weight of nylon, balance cotton, a flame retarding amount of a cyclic phosphonate ester flame retardant that fixed onto nylon fibers mixed with a flame retarding amount of tetrakis-(hydroxymethyl)phosphonium salt/urea that fixes onto cotton fibers; and thereafter (2) curing the fabric at elevated temperatures to fix the flame retardants to the nylon and to the cotton, the treated fabric containing at least 1.6% phosphorus after 25 launderings.

* * * * *